US008154843B2

(12) United States Patent
Roscoe et al.

(10) Patent No.: US 8,154,843 B2
(45) **Date of Patent: *Apr. 10, 2012**

(54) DUAL POWER SOURCE PULSE GENERATOR FOR A TRIGGERING SYSTEM

(75) Inventors: George William Roscoe, West Hartford, CT (US); John James Dougherty, Collegeville, PA (US); Cecil Rivers, Hartford, CT (US); Thangavelu Asokan, Karnataka (IN); Adnan Kutubuddin Bohori, Karnataka (IN)

(73) Assignee: General Electric Company, Schenectady, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/169,757

(22) Filed: Jun. 27, 2011

(65) Prior Publication Data

US 2011/0254455 A1 Oct. 20, 2011

Related U.S. Application Data

(63) Continuation of application No. 12/203,507, filed on Sep. 3, 2008, now Pat. No. 7,986,505.

(51) Int. Cl.
*H01T 23/00* (2006.01)
*F41B 15/04* (2006.01)
*F02P 3/06* (2006.01)

(52) U.S. Cl. ..... 361/230; 361/232; 361/257

(58) Field of Classification Search ..... 361/230
See application file for complete search history.

(56) References Cited

U.S. PATENT DOCUMENTS

| | | | | |
|---|---|---|---|---|
| 5,471,362 | A * | 11/1995 | Gowan | 361/257 |
| 5,793,585 | A * | 8/1998 | Cowan | 361/1 |
| 6,647,974 | B1 * | 11/2003 | Cowan | 123/604 |
| 7,986,505 | B2 * | 7/2011 | Roscoe et al. | 361/230 |
| 2006/0168872 | A1 * | 8/2006 | Locklear | 43/17.1 |
| 2008/0239598 | A1 | 10/2008 | Asokan et al. | |
| 2008/0253040 | A1 * | 10/2008 | Asokan et al. | 361/2 |
| 2008/0288189 | A1 * | 11/2008 | Rao et al. | 702/59 |

FOREIGN PATENT DOCUMENTS

| | | |
|---|---|---|
| AU | 6419969 A | 5/1971 |
| EP | 1015161 B1 | 6/2006 |

OTHER PUBLICATIONS

European Search Report for EP Application No. 09168653.5—filed Aug. 26, 2009, Date of Completion: Oct. 25, 2011; 3 pgs.

* cited by examiner

*Primary Examiner* — Dharti Patel
(74) *Attorney, Agent, or Firm* — Cantor Colburn LLP

(57) ABSTRACT

An ablative plasma gun having a dual power source pulse generator is configured to generate a high voltage low current pulse and a low voltage high current pulse. A pair of electrodes are disposed and configured to receive the high voltage low current pulse, and to receive the low voltage high current pulse in response to the high voltage low current pulse.

15 Claims, 5 Drawing Sheets

DUAL POWER SOURCE PULSE GENERATOR FOR A TRIGGERING SYSTEM

CROSS REFERENCE TO RELATED APPLICATIONS

This application is a continuation application of U.S. application Ser. No. 12/203,507 filed Sep. 3, 2008, which is hereby incorporated by reference in its entirety.

BACKGROUND

This invention relates to current pulse generator for a triggering system. More particularly, this invention relates to a dual power source pulse generator for a triggering system.

Generally, high current pulse sources have several applications in high voltage, power switching devices such as an ablative plasma gun for triggering an arc flash mitigation device, a rail gun, spark gap switches, a lighting ballast and series capacitor protection, for example. Conventionally, these devices include two or more main electrodes separated by a main gap of air or gas, and a bias voltage is applied to the main electrodes across the main gap.

The high current pulse source provides the high current pulse to trigger the ablative plasma gun to generate conductive ablative plasma vapors between the main electrodes. The high current pulse is typically greater than approximately 5,000 Amps (5 kA) to generate adequate plasma vapors, for example. Also, high voltage greater than approximately 5,000 Volts (5kV) is utilized to overcome a breakdown voltage of air and initiate the high current pulse across pulse electrodes. Typically, high current pulses, e.g. lightning current pulses are defined as having an 8 μs rise time/20 μs fall time. High current pulses are commonly generated through high energy high voltage capacitor discharge that can have capacitive values in the millifarad range. High voltage high energy capacitors are very expensive and it makes the single capacitor pulse source economically unfeasible for most of the applications except for some laboratory equipment. Thus, there is a need for a cost effective pulse generator system for a triggering system.

BRIEF DESCRIPTION

An embodiment of the present invention provides a dual power source pulse generator for a triggering system. The dual power source pulse generator in power connection with a pair of electrodes having a first electrode, a second electrode and an air gap therebetween. The dual power source pulse generator includes a first pulse source producing a high voltage low current pulse across the pair of electrodes to allow dielectric breakdown, and a second pulse source electrically connected in parallel with an output of the first pulse source and the pair of electrodes, and producing a low voltage high current pulse to thereby produce a current flow of high-density plasma between the same electrodes of the pair of electrodes in response to the high voltage low current pulse.

Another embodiment of the present invention provides an ablative plasma gun. The ablative plasma gun includes a barrel having an opening, a dual power source pulse generator which generates a high voltage low current pulse and a low voltage high current pulse, and a pair of electrodes having an air gap formed therebetween in power connection with the dual power source pulse generator via a single pair of conductors, and receiving the high voltage low current pulse and the low voltage high current pulse. An arc is generated across the air gap to create conductive plasma vapors emitted out of the opening of the barrel in response to the high voltage low current pulse and the low voltage high current pulse generated.

A further embodiment of the present invention includes an ablative plasma gun having a dual power source pulse generator configured to generate a high voltage low current pulse and a low voltage high current pulse, and a pair of electrodes disposed and configured to receive the high voltage low current pulse, and to receive the low voltage high current pulse in response to the high voltage low current pulse.

Another embodiment of the present invention includes an ablative plasma gun having a dual power source pulse generator, and a pair of electrodes. The dual power source pulse generator includes a high voltage low current pulse source configured to generate a high voltage low current pulse, and a low voltage high current pulse source configured to generate a low voltage high current pulse. The low voltage high current pulse source is electrically connected with an output of the high voltage low current pulse source, wherein in response to the high voltage low current pulse the dual power source pulse generator is configured to generate a low voltage high current pulse to produce a current flow between the electrodes.

Additional features and advantages are realized through the techniques of exemplary embodiments of the invention. Other embodiments and aspects of the invention are described in detail herein and are considered a part of the claimed invention. For a better understanding of the invention with advantages and features thereof, refer to the description and to the drawings.

DETAILED DESCRIPTION

Figure 1:
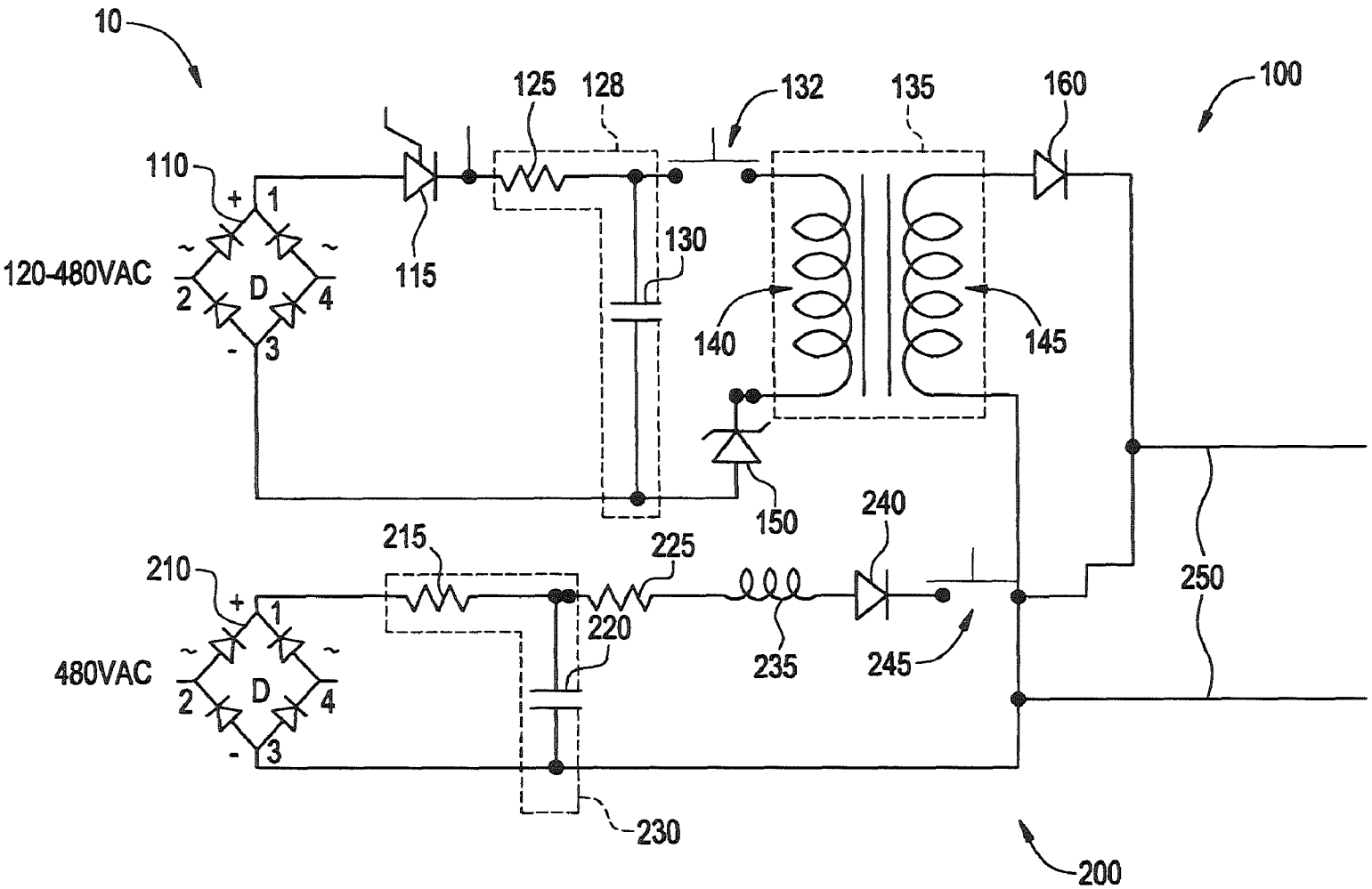
FIG. 1 is a circuit diagram of a dual power source pulse generator for a triggering system that can be implemented within embodiments of the present invention.
Figure 2:
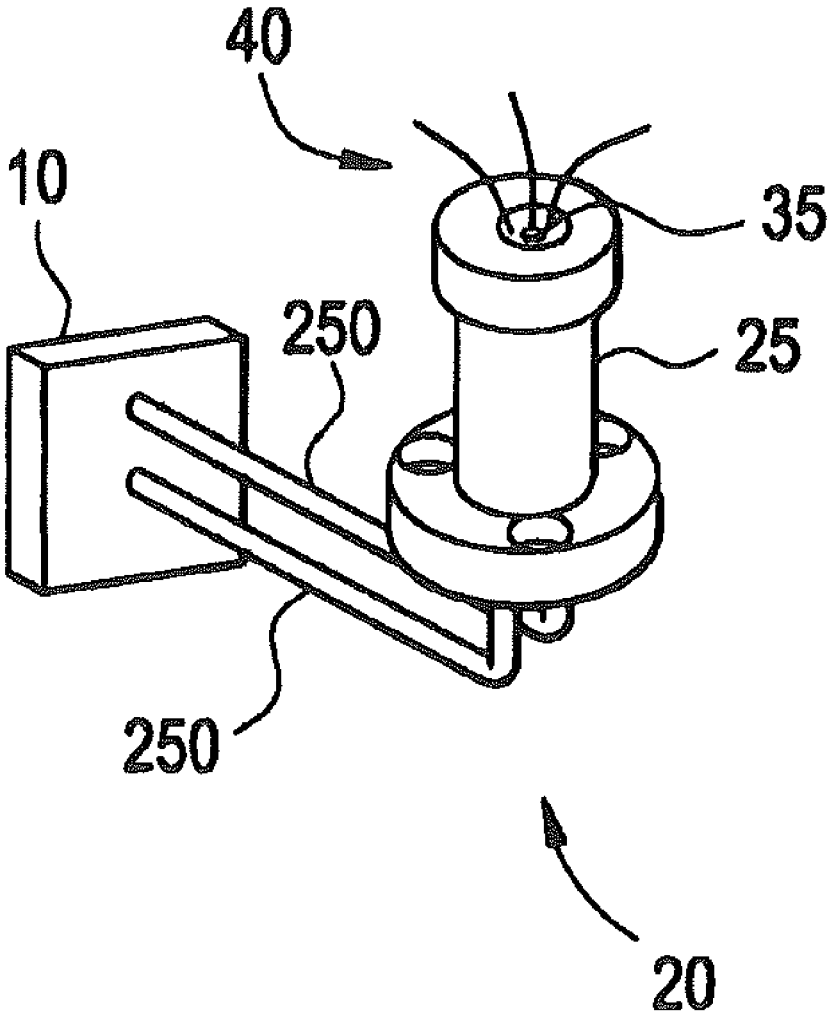
FIG. 2 is a schematic diagram of an ablative plasma gun and the dual power source pulse generator of FIG. 1 that can be implemented within embodiments of the present invention.

Turning now to the drawings in greater detail, it will be seen that in FIG. 1, there is a dual power source pulse generator 10 for a triggering system, for example, an ablative plasma gun 20 (depicted in FIG. 2, for example). The present invention is not limited to being used for an ablative plasma gun, and may therefore be used to develop high current pulse in other applications such as rail guns, spark gap switches, lighting blasts, series capacitor protection circuits, etc.

According to an exemplary embodiment, the dual power source pulse generator 10 includes a first pulse source 100 i.e., a high voltage (low current) pulse source 100 and a second pulse source 200 i.e., a low voltage (high current) pulse source 200. A controller (not shown) supplies a trigger or enable signal 60 (depicted in FIG. 5) to the high voltage pulse source 100 and the low voltage pulse source 200.

Figure 3:
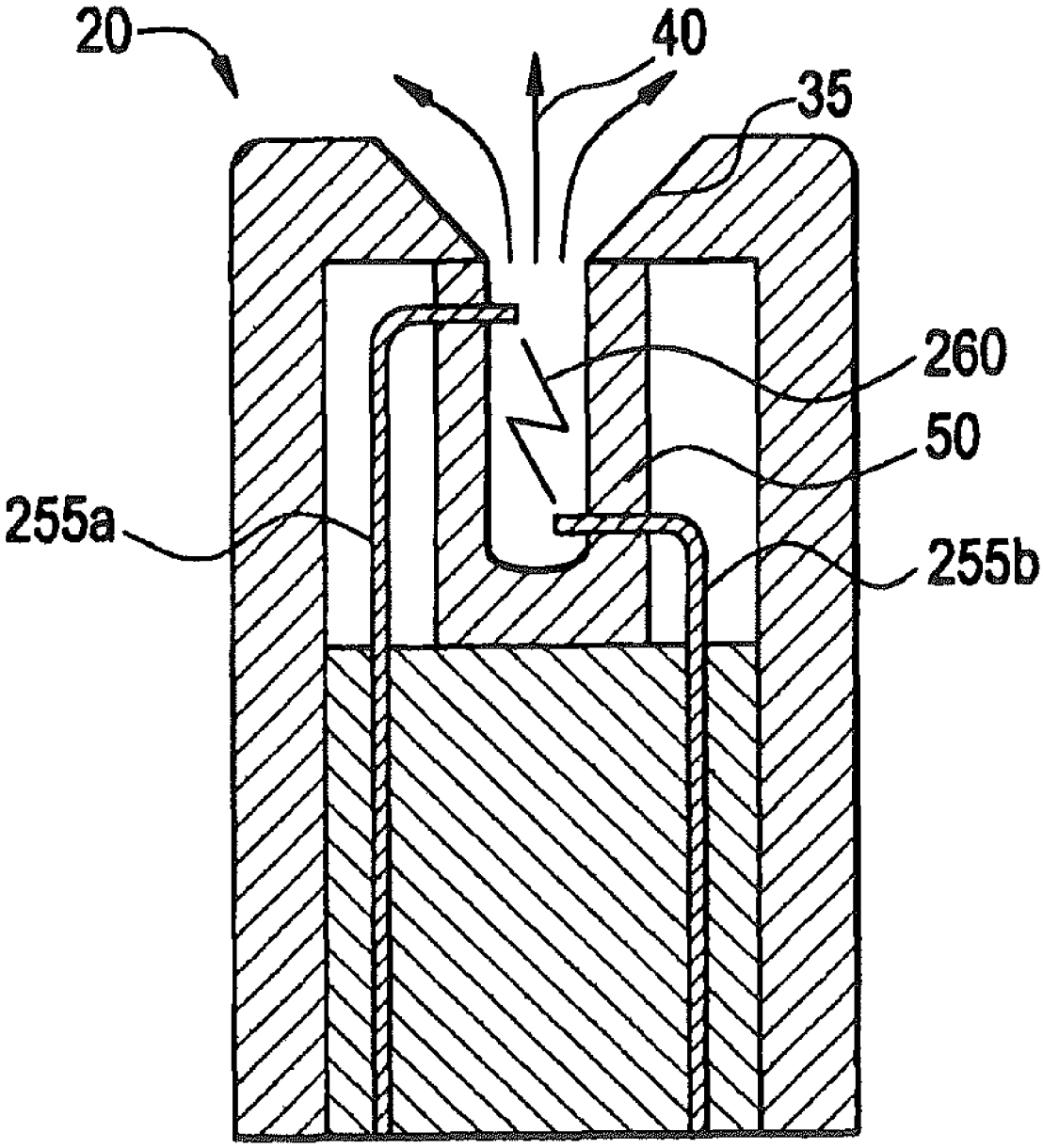
FIG. 3 is a schematic diagram of a barrel of the ablative plasma gun of FIG. 2 that can be implemented within embodiments of the present invention.
Figure 4:
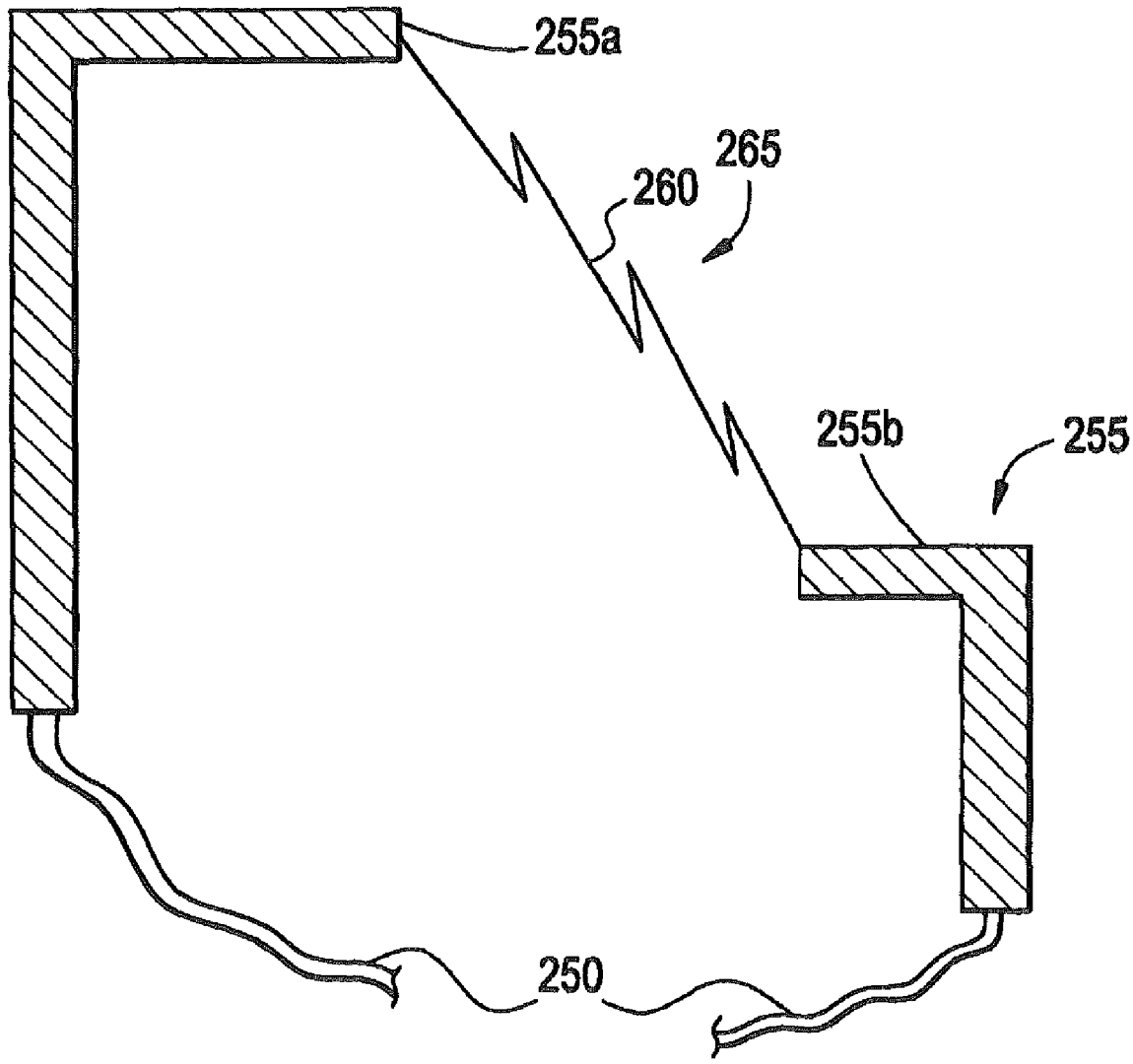
FIG. 4 is a schematic diagram of pair of electrodes shown in FIG. 3 that can be implemented within embodiments of the present invention.

According to an exemplary embodiment, the high voltage pulse source 100 and the low voltage pulse source 200 are in power connection with a pair of electrodes 255 (first and second electrodes 255*a* and 255*b* (depicted in FIGS. 3 and 4, for example). The high voltage pulse source 100 produces a high voltage low current pulse across the pair of electrodes 255 to allow dielectric breakdown. The low voltage high current pulse source 200 is electrically connected with an output of the high voltage low current pulse source 100 and produces a low voltage high current pulse to thereby produce a current flow of high-density plasma between the electrodes 255*a* and 255*b* of the pair of electrodes 255 in response to the high voltage low current pulse.

As shown in FIG. 1, the high voltage pulse source 100 may be a capacitor discharge circuit or a pulse transformer-based, for example. According to the current exemplary embodiment, the high voltage pulse source 100 comprises a rectifier 110 in power connection with a power source (not shown), a diode 115 e.g., a silicon-controlled rectifier (SCR) disposed in series with the rectifier 110, a resistor 125 and a capacitor 130 forming a resistive-capacitive charging circuit 128 and a switch 132 disposed in series with the capacitor 130. The high voltage pulse source further includes a high voltage pulse transformer 135 having a primary winding 140 and a secondary winding 145, and a diode 150 (i.e. a spark gap). The primary winding 140 is in power connection with the power source through the switch 132 and the secondary winding is in power connection with the pair of electrodes 255 and a diode 160 is electrically connected between the secondary winding 145 and the first electrode 255*a* of the pair of electrodes 255.

According to an exemplary embodiment, the low voltage pulse source 200 comprises a rectifier 210 in power connection with a power source and a resistive-capacitive charging circuit 230 including a resistor 215 and a capacitor 220. The capacitor 220 is in parallel with the pair of electrodes 255 and the resistor 215 is in series connection with the capacitor 220. The low voltage pulse source 200 further includes a resistor 225, an inductor 235, a diode 240 and a discharge switch 245. An operation of the high voltage pulse source 100 and the low voltage pulse source 200 will now be described in detailed.

According to an exemplary embodiment, the high voltage pulse source receives a first voltage of approximately 120 to 480 volts alternating current. The capacitor 130 charges to a predetermined voltage of approximately 240V, for example. When the dual power source pulse generator 10 is triggered via a trigger signal 60 (depicted in FIG. 5, for example), the switch 132 is closed and sends a pulse through the primary winding 140 of the pulse transformer 135 into the spark gap 150 and the spark gap 150 short circuits or breaks down at the predetermined voltage of the capacitor 130. In response, a second voltage potential is establish via the secondary winding 145 of the transformer 135 across the pair of electrodes 255, and thus, an output of a high voltage (low current) pulse is created of approximately 15,000 V which is high enough to overcome the breakdown voltage of air at a gap 265 (depicted in FIG. 4) between the first and second electrodes 255*a* and 255*b* of the pair of electrodes 255. The high voltage pulse is initially applied to the first and second electrodes 255*a* and 255*b* to reduce the impedance of the air gap 265, and triggers the low voltage pulse source 200. At this time, an arc 260 (depicted in FIG. 4) formed between the air gap 265 is a low energy arc but the impedance is significantly reduced due to breakdown voltage.

Further, as shown in FIG. 1, according to an exemplary embodiment, the low voltage pulse source 200 is a capacitive discharge circuit, for example. Thus, the low voltage pulse source 200 is obtained by capacitor discharge using a microfarad range capacitor which generates high current of approximately 5 kA at a voltage lower than approximately 1 kV. The low voltage pulse source 200 receives a second voltage of approximately 480 VAC from a power source, and the capacitor 220 charges up to approximately 600V. The low voltage (high current) pulse source 200 is subsequently triggered across the same pair of electrodes 255 whose impedance is reduced significantly due to the high voltage arc 260. This allows the high current to flow across the pair of electrodes 255 despite the low voltage. The energy of the arc 260 therefore increases significantly as it allow high current to flow. That is, the high voltage low current pulse is initially applied the pair of electrodes 255 to reduce an impedance of the air gap 265 and the arc 260 is formed between the air gap 265, and a low voltage high current pulse is then triggered across the same pair of electrodes 255 to enable high current to flow across the pair of electrodes 255.

According to an exemplary embodiment, the diode 240 blocks high voltage current from flowing into the low voltage pulse source 200.

According to an exemplary embodiment, the high voltage pulse source 100 and the low voltage pulse source 200 are connected together via a rectification bridge.

According to an exemplary embodiment, the use of the pair of electrodes 255 reduces gun barrel ionization requirements.

FIG. 2 is a schematic diagram of an ablative plasma gun 20 using the dual power source pulse generator 10 (shown in FIG. 1, for example). The plasma gun 20 includes the dual power source pulse generator 10 having the high voltage pulse source 100 and the low voltage pulse source 200 and the single pair of conductors 250. The plasma gun 20 further includes a barrel 25 including an opening 35. The plasma gun 20 emits plasma vapors 40 out of the opening 35.

FIG. 3 is a schematic diagram of the barrel 25 of the ablative plasma gun 20 in FIG. 2. FIG. 3 shows the plasma gun 20 having the pair of electrodes (first and second electrodes 255*a* and 255*b*) in the barrel 25, a cup of ablative material 50 and the opening 35. When the dual power source pulse generator 10 is in power connection with the ablative plasma gun, the dual power source pulse generator 10 provides high voltage (low current) and low voltage (high current) pulses to the ablative plasma gun 20 which creates an arc 260 across the air gap 265 that heats and ablates the ablative material to create the conductive plasma vapors 40.

FIG. 4 is a schematic diagram of a pair of electrodes of the ablative plasma gun shown in FIG. 3. The pair of electrodes 255 (first and second electrodes 255*a* and 255*b*) are disposed proximate each other within an interior of the barrel 35. The electrodes 255*a* and 255*b* are in power connection with the single pair of conductors 250. An arc 260 is generated between the electrodes 255*a* and 255*b*. The arc 260 may include more than one arc disposed between the electrodes 255*a* and 255*b*. According to an exemplary embodiment of the present invention, the generation of the arc 260 represents a high voltage low current pulse and a low voltage high current pulse.

Figure 5:
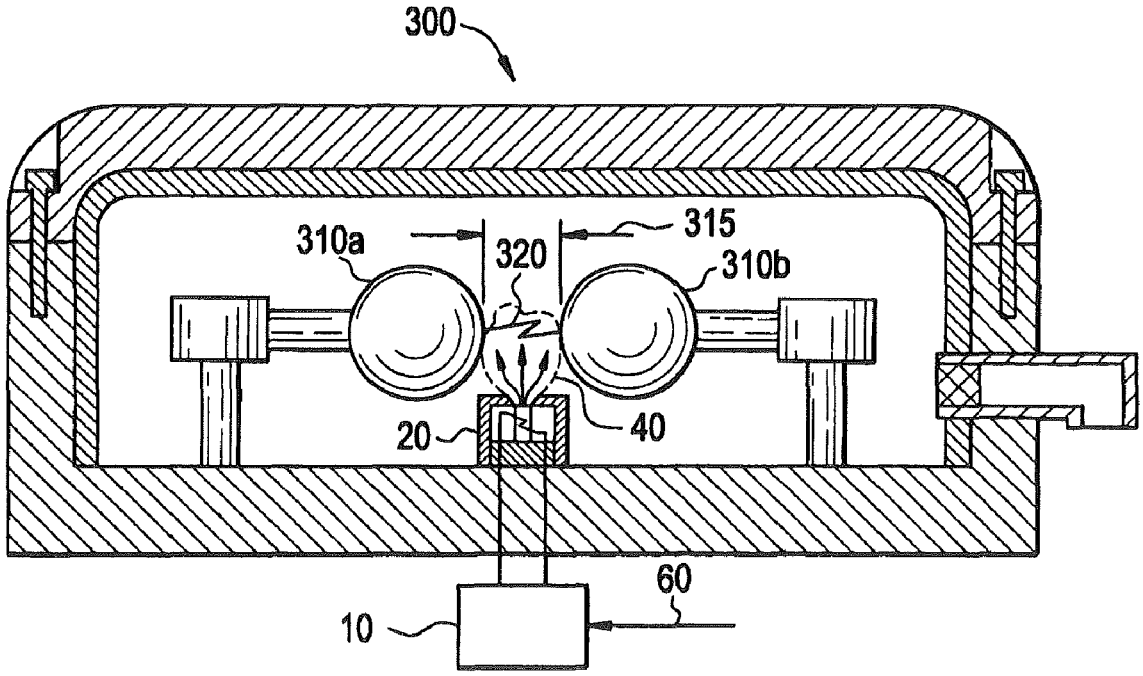
FIG. 5 is a schematic diagram of an arc flash mitigation device that can be implemented within exemplary embodiments of the present invention

FIG. 5 is a schematic diagram of an arc flash mitigation device that can be implemented within exemplary embodiments of the present invention. As shown in FIG. 5, an arc flash mitigation device 300 having main electrodes 310*a* and 310*b* in communication with the ablative plasma gun 20 (depicted in FIG. 2) in power communication with the dual power source pulse generator 10 (depicted in FIG. 1). The dual power source pulse generator 10 receives an enabling or triggering signal 60 and in turn sends a pulse to the ablative plasma gun 20 which causes it to inject plasma vapors 40 into a main gap 315 between the main electrodes 310*a* and 310*b* of the arc mitigation device 300, thereby initiating a protective arc 320. The dual power source pulse generator 10 of the present invention is not limited being utilized for an arc flash mitigation device and therefore, may be utilized for triggering a rail gun, spark gap switches, lighting ballasts, and series capacitor protection, for example.

According to an exemplary embodiment of the present invention the use of a dual power source pulse generator 10 provides the advantage of the energy of the arc being higher since it allows high current to flow. Further, the use of low voltage components on a high current pulse circuit allows the dual power pulse source pulse generator 10 to be cost effective and compact in size.

While the invention has been described with reference to exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims. Moreover, the use of the terms first, second, etc. do not denote any order or importance, but rather the terms first, second, etc. are used to distinguish one element from another.

The invention claimed is:

1. An ablative plasma gun, comprising:

a dual power source pulse generator configured to generate a high voltage low current pulse and a low voltage high current pulse; and a pair of electrodes disposed and configured to receive the high voltage low current pulse, and to receive the low voltage high current pulse in response to the high voltage low current pulse.

2. The ablative plasma gun of claim 1, further comprising an air gap disposed between the pair of electrodes, wherein in response to the high voltage low current pulse and the low voltage high current pulse a condition is generated across the air gap sufficient to create an arc across the air gap.

3. The ablative plasma gun of claim 1, wherein the pair of electrodes are disposed in power communication with the dual power source pulse generator.

4. The ablative plasma gun of claim 3, wherein the pair of electrodes are disposed in power communication with the dual power source pulse generator via a single pair of conductors.

5. The ablative plasma gun of claim 1, wherein the dual power source pulse generator comprises:

a first pulse source electrically connected with the pair of electrodes, and configured to produce a high voltage low current pulse across the pair of electrodes; and a second pulse source electrically connected in parallel with an output of the first pulse source and the pair of electrodes, and configured to produce a low voltage high current pulse across the pair of electrodes in response to the high voltage low current pulse.

6. The ablative plasma gun of claim 5, wherein the first pulse source and the second pulse source are connected via a plurality of diodes.

7. The ablative plasma gun of claim 5, wherein the first pulse source comprises:

a rectifier;

a first diode disposed in power communication with the rectifier;

a charging circuit comprising a capacitor, the charging circuit disposed in power communication with the first diode;

a switch disposed in power communication with the capacitor;

a pulse transformer having a primary winding and a secondary winding, the primary winding disposed in power connection with the rectifier through the switch, and the secondary winding disposed in power connection with the pair of electrodes; and a second diode electrically connected between the secondary winding and the pair of electrodes.

8. The ablative plasma gun of claim 5, wherein the second pulse source comprises:

a rectifier; and a charging circuit in power connection between the rectifier and the pair of electrodes.

9. The ablative plasma gun of claim 8, wherein the charging circuit comprises:

a capacitor disposed in power communication with the pair of electrodes; and a first resistor electrically connected between the rectifier and the capacitor.

10. The ablative plasma gun of claim 8, wherein the second pulse source further comprises:

an inductor disposed in power communication with the capacitor;

a second resistor disposed in electrical communication with the charging circuit and the inductor; and a diode disposed in power connection between the first pulse source and the charging circuit.

11. The ablative plasma gun of claim 9, wherein the capacitor is chargeable up to approximately 600 V.

12. The ablative plasma gun of claim 10, wherein the second pulse source further comprises a switch in power connection between the charging circuit and the pair of electrodes.

13. The ablative plasma gun of claim 1, further comprising:

a barrel having an opening;

wherein the pair of electrodes are disposed within the barrel.

14. The ablative plasma gun of claim 2, further comprising:

a barrel having an opening, the pair of electrodes being disposed within the barrel; and ablative material disposed within the barrel.

15. An ablative plasma gun, comprising:

a dual power source pulse generator comprising a high voltage low current pulse source configured to generate a high voltage low current pulse, and a low voltage high current pulse source configured to generate a low voltage high current pulse; and a pair of electrodes;

wherein the low voltage high current pulse source is electrically connected with an output of the high voltage low current pulse source, and wherein in response to the high voltage low current pulse the dual power source pulse generator is configured to generate a low voltage high current pulse to produce a current flow between the electrodes.

* * * * *